United States Patent [19]

Chuan

[11] Patent Number: 4,928,955

[45] Date of Patent: May 29, 1990

[54] TOY HAVING SLIDING RAIL

[76] Inventor: Chuang-Tien Chuan, No. 40, Lane 174, Ta Hsin St., Tainan, Taiwan

[21] Appl. No.: 356,556

[22] Filed: May 25, 1989

[51] Int. Cl.[5] ..... A63H 13/20

[52] U.S. Cl. ..... 272/31 R; 446/137; 446/171; 272/31 A

[58] Field of Search ..... 446/129, 137, 138, 139, 446/424, 425, 168, 171, 230, 231, 444, 236; 272/31 R, 31 A, 31 B

[56] References Cited

U.S. PATENT DOCUMENTS

| | | | |
|---|---|---|---|
| 2,451,006 | 10/1948 | West | 272/31 B |
| 3,562,950 | 2/1971 | Genin | 446/444 X |
| 4,091,561 | 5/1978 | Kimura | 446/137 |
| 4,128,964 | 12/1978 | Ogasawara | 446/424 X |
| 4,708,685 | 11/1987 | Udagawa | 446/171 X |

FOREIGN PATENT DOCUMENTS

| | | | |
|---|---|---|---|
| 2074462 | 11/1981 | United Kingdom | 446/137 |

*Primary Examiner*—Mickey Yu
*Attorney, Agent, or Firm*—Clifford A. Poff

[57] ABSTRACT

A toy includes a base, a curved sliding rail having a first end and a second opposite end, a tower having thereon a waved continuous guiding surface, a rotatable shaft in the tower, a flying piece guided to revolve along the waved guiding surface, and a sliding piece capable of sliding from the first end to the second opposite end and capable of being carried from the second end to the first end by the flying piece. The flying piece and sliding piece each having a magnetic member thereon for attracting each other to perform the carrying function.

4 Claims, 3 Drawing Sheets

TOY HAVING SLIDING RAIL

BACKGROUND OF THE INVENTION

The present invention relates to a toy, and more particularly to a toy having a sliding rail.

The toy is usually designed to interestingly simulate a natural being, e.g. a little girl or an animal, or a real article, e.g. a car or a watch. The present invention is also based on this idea.

SUMMARY OF THE INVENTION

It is therefore an object of the present invention to provide a creatively designed toy having a sliding rail.

According to the present invention, a toy includes a base, a curved sliding rail including a first end having a platform and an adjacent separating frame and a second opposite end having a stopping piece and an adjacent obstacle wall, a tower having thereon a waved continuous guiding surface, a shaft rotatably mounted in the tower, a flying piece having an extended arm pivotally attached to the shaft and guided to revolve along the waved guiding surface, and a sliding piece capable of being carried by the flying piece to fly over the obstacle wall and capable of being separated by the separating frame from the flying piece to drop down on the sliding rail to slide to the stopping piece.

BRIEF DESCRIPTION OF THE DRAWING

The present invention may best be understood through the following description with reference to the accompanying drawings, in which.

DETAILED DESCRIPTION OF THE PREFERRED EMBODIMENT

Figure 1:
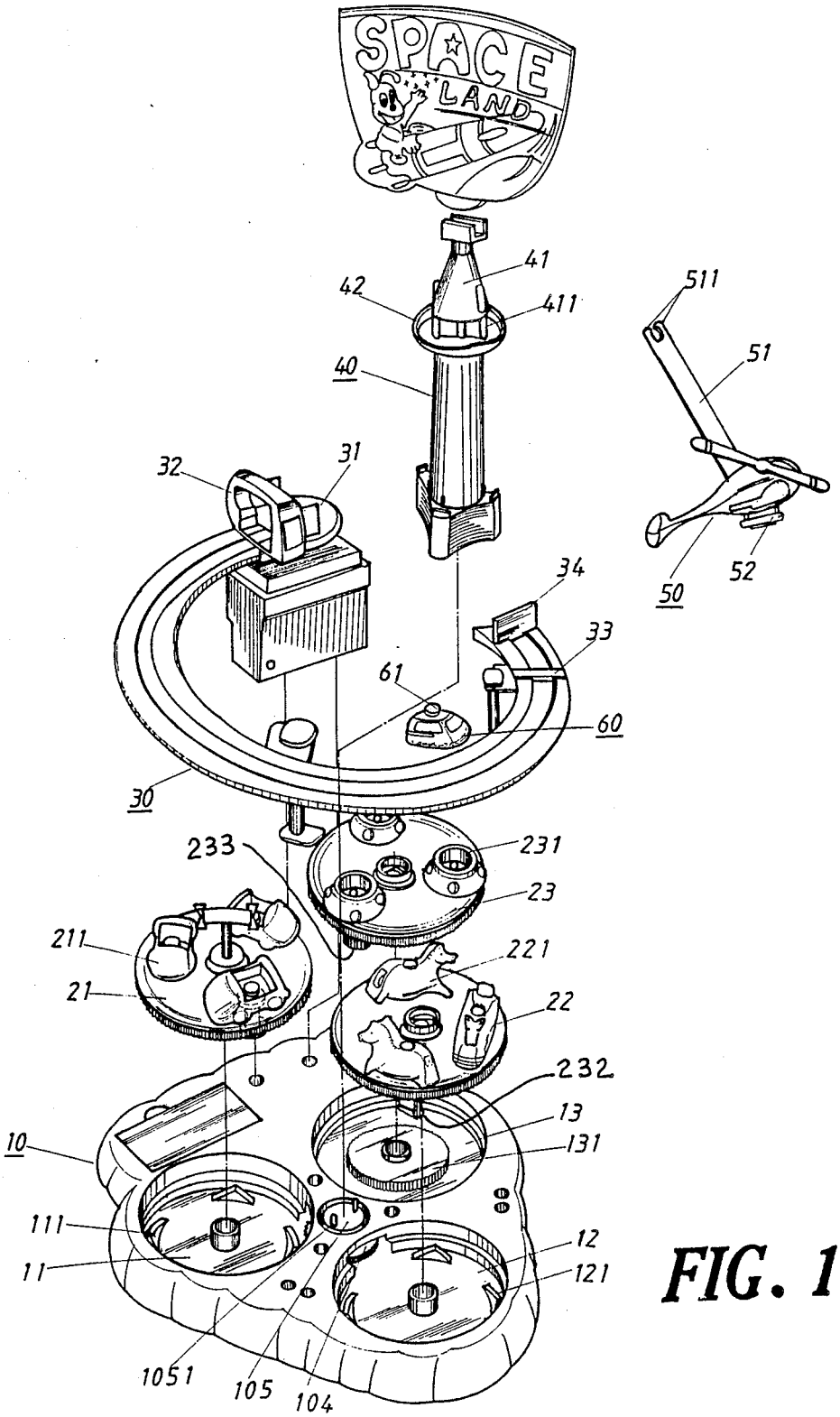
FIG. 1 is an exploded view showing a toy having a sliding rail according to the present invention.
Figure 2:
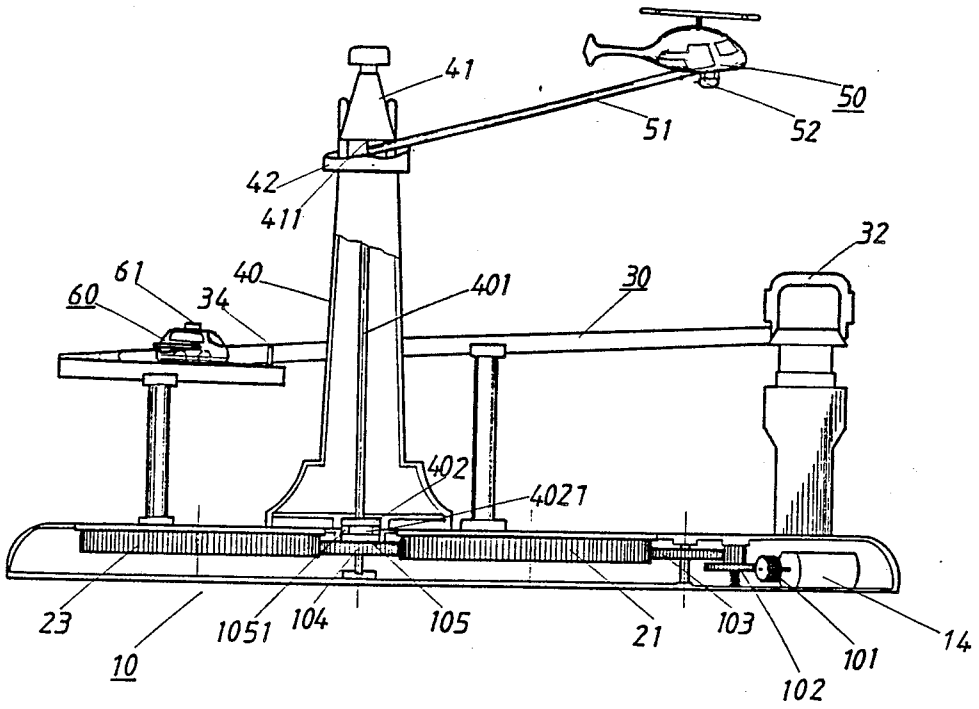
FIG. 2 is a partial sectional view showing the toy of FIG. 1.
Figure 3:
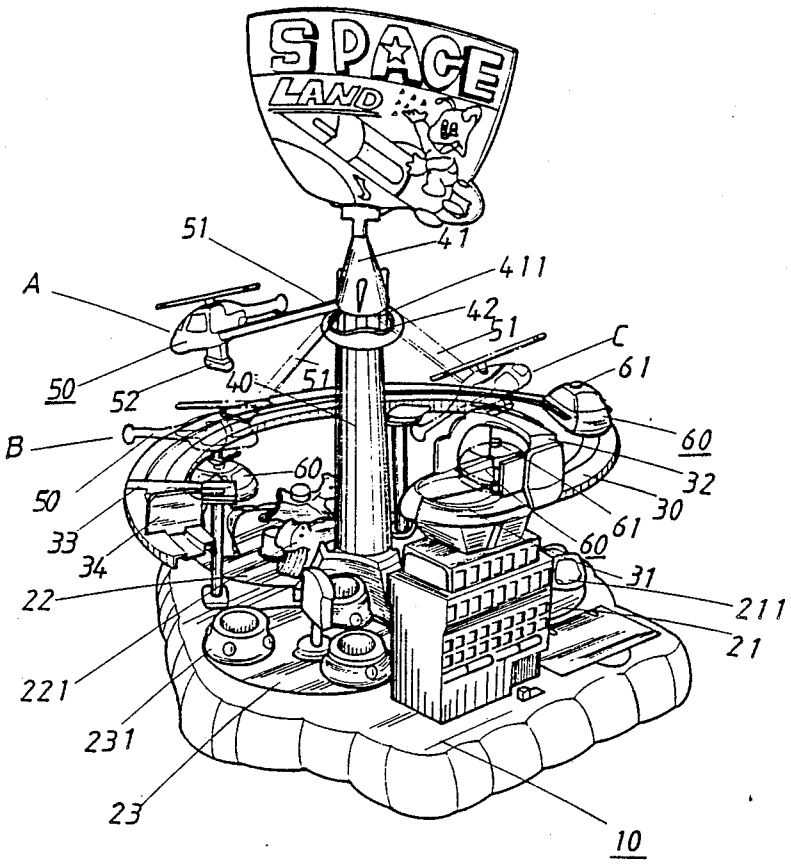
FIG. 3 is a perspective view schematically showing the toy of FIG. 1 in operation.

Referring now to FIGS. 1 to 3, a toy having a sliding rail according to the present invention includes a base 10, a curved sliding rail 30, a tower 40 having therein a rotatable shaft 401, a flying piece 50, and a sliding piece 60. Base 10 includes 3 holes 11, 12, 13, a motor 14 a worm 101, a worm gear 102, a driving gear 11 driven by driving gear 103 and in turn driving disk 21 in hole 11 driven by driving gear 103 and in turn driving rotating disks 22, 23, and a transmitting disk 105 secured on central gear 104 and having two projections 1051 in the manner that when rotating disks 21, 22, 23 are rotated, followers thereon 211, 221, 231 will have a waved revolving movement as to the two former followers and a revolutional movement as to follower 231 through the provisions of projections 111, 121 and the gears 131 in holes 11, 12, and 13 respectively.

IN referring to FIG. 1, the projections 111, 121 periodically engage downwardly extending projections 232 provided on the underneath surfaces of the disks 21 and 22, one being partially shown as to the disk 22. The gear 131 is adapted to mesh with downwardly projecting gears 233, one for each follower 231, one of the projecting gears 233 being partially shown at the front of the disk 23 in FIG. 1. Sliding rail 30 is inclinedly mounted on base 10 and includes a first end having a platform 31 and an adjacent separating frame 32 and a second opposite end having a stopping piece 33 and an adjacent obstacle wall 34. The rail is downwardly inclined from the first end to the second opposite end. Shaft 401 mounts thereunder the transmitting disk 105 and mounts thereabove a cap 41 having pivoting piece 411. Tower 40 is secured on base 10 and includes thereon a waved or curved continuous guiding surface 42.

Flying piece 50 being helicopter-shaped in the present embodiment includes an extended are 51 which has the free end thereof suitably grooved to be capable of being pivoting mounted on pivotally piece 411 and is guided to revolve along wavy guiding surface 42 when shaft 401 rotates. Sliding piece 60 includes a top magnetic element 61 capable of attracting a bottom magnetic element 52 of flying piece 50.

Through engaging projections 1051, 4021, central gear 104 rotates shaft 401 and cap 41 which in turn revolve extended arm 51 and flying piece 50 simultaneously having a wavy movement through the provision of guiding surface 42. As better shown in FIG. 3, the present invention is designed in the manner that when flying piece 50 is in a position ready to be downwardly pivoted, sliding piece 60 is stopped at stopping piece 33 so that when flying piece 50 is at its lowest position, magnetic elements 52, 61 attract each other so that flying piece 50 carries therewith sliding piece 60 to fly over obstacle wall 34, as schematically shown at the dotted position B. Flying piece 50 downwardly pivots again at the front of platform 31 so that when if flies over separating frame 32, separating frame 32 will separate flying piece 50 from sliding piece 60 to allow sliding piece 60 to be dropped down to platform 31, as schematically shown at the dotted position C, to slide downwardly along sliding rail 30 to be stopped by stopping piece 33.

In addition to the revolving followers 211, 221, 231, flying piece 50 and the sliding piece 60 an important aspect of the invention resides in the provisions of the obstacle wall 34 and the separating frame 32.

Although a preferred embodiment has been described, it will be apparent to one skilled in the art that changes can be made therein without departing from the scope of the invention.

I claim

1. A toy comprising:

a base adapted to receive a power means; a curved sliding rail mounted above said base, and including a first end having a platform and an adjacent separating means and a second opposite end having a stopping means and an adjacent obstacle means;

a tower secured on said base and having thereon a waved continuous guiding surface;

a shaft rotatably mounted in said tower and adapted to be driven by said power means;

a flying piece having a carrying means and an extended arm which is pivotally attached to said shaft and guided to revolve along said wave guiding surface; and a sliding piece supportable by said platform including means engagable by said carrying means so as to be capable of being carried by said flying piece when it stops at said stopping means to fly over said obstacle means and capable of being separated by said separating means from said carrying flying piece to drop down on said sliding rail to slide to said stopping means.

2. A toy according to claim 1, further comprising a cap secured to said shaft and pivotally attaching thereto said extended arm.

3. A toy according to claim 1, wherein said engaging means is arranged at the top of said sliding piece and said carrying means is arranged at the bottom of said flying piece and said engaging means and carrying means are respectively provided with magnetic means capable of attracting each other in order that said flying piece can carry therewith said sliding piece.

4. A toy according to claim 1 wherein said sliding rail is downwardly inclined from said first end to said second opposite end.

* * * * *